US005562034A

United States Patent [19]

Fox

[11] Patent Number: 5,562,034

[45] Date of Patent: Oct. 8, 1996

[54] MEDIA ROLL BRAKING SYSTEM FOR A THERMAL LABEL PRINTER

[75] Inventor: Duane M. Fox, Snohomish, Wash.

[73] Assignee: Intermec Corporation, Everett, Wash.

[21] Appl. No.: 507,783

[22] Filed: Jul. 26, 1995

[51] Int. Cl.[6] ..... B41F 13/54

[52] U.S. Cl. ..... 101/228; 400/613

[58] Field of Search ..... 400/234, 613; 101/91, 228, 288, DIG. 42; 242/410, 416, 419.8, 419.9, 421, 422.4, 156, 156.2

[56] References Cited

U.S. PATENT DOCUMENTS

| | | | |
|---|---|---|---|
| 3,618,870 | 11/1971 | Martin | 242/156.2 |
| 3,866,851 | 2/1975 | Brooks . | |
| 3,899,143 | 8/1975 | Slezak . | |
| 3,949,949 | 4/1976 | Thompson . | |
| 3,985,603 | 10/1976 | Berner . | |
| 3,985,605 | 10/1976 | Treiber et al. . | |
| 3,989,929 | 11/1976 | Treiber . | |
| 4,264,399 | 4/1981 | Stevens et al. | 242/156.2 |
| 4,350,454 | 9/1982 | Schoenlein | 400/234 |
| 4,363,692 | 12/1982 | Imamura et al. . | |
| 4,521,125 | 6/1985 | Turbon | 400/234 |
| 4,721,267 | 1/1988 | Nieto et al. . | |
| 4,742,973 | 5/1988 | Stomski et al. | 242/156 |
| 4,905,927 | 3/1990 | Lesse | 242/156.2 |
| 5,051,011 | 9/1991 | Satoh et al. | 400/234 |
| 5,338,443 | 8/1994 | McEwen . | |

FOREIGN PATENT DOCUMENTS

| | | | |
|---|---|---|---|
| 194971 | 9/1988 | Japan | 400/234 |

*Primary Examiner*—Ren Yan
*Attorney, Agent, or Firm*—Graham & James

[57] ABSTRACT

A brake apparatus for a printer is provided which rapidly decelerates and stops a rotating roll of print media in between printing operations, and allows the roll to rotate freely during printing operations. The printer includes a print head mechanism that draws a print media to a print region from a roll of the print media. A roller supports the roll of print media and permits the roll to rotate freely upon application of a drawing force from the print head mechanism. A brake drum is axially coupled to the roller. A lever arm is affixed at a first end thereof to a support structure of the printer and is pivotal between a first position and a second position. A second end of the lever arm has a pedal disposed at a portion of a path along which the print media follows toward the print region. The lever arm is pivoted to the first position by tightening of the print media upon application of the drawing force from the print head mechanism, and is pivoted to the second position upon slackening of the print media. A brake pad is coupled to an intermediate portion of the lever arm, and comes into contact with the brake drum only upon pivoting of the lever arm to the second position.

19 Claims, 5 Drawing Sheets

MEDIA ROLL BRAKING SYSTEM FOR A THERMAL LABEL PRINTER

BACKGROUND OF THE INVENTION

1. Field of the Invention

The present invention relates to thermal transfer printing, and more particularly, to an apparatus for braking a rotating print media roll in between printing operations.

2. Description of Related Art

In the field of bar code symbology, vertical bars of varying thicknesses and spacing are used to convey information, such as an identification of the object to which the bar code is affixed. The bar codes are typically printed onto paper substrate labels having an adhesive backing layer that enables the labels to be affixed to objects to be identified. To read the bar code, the bars and spaces are scanned by a light source, such as a laser. Since the bars and spaces have differing light reflective characteristics, the information contained in the bar code can be read by interpreting the laser light that reflects from the bar code. In order to accurately read the bar code, it is thus essential that the bar code be printed in a high quality manner, without any streaking or blurring of the bar code. At the same time, it is essential that the adhesive backing layer of the labels not be damaged by heat generated during the printing process.

In view of these demanding printing requirements, bar codes are often printed using thermal transfer printing techniques. In thermal transfer printing, a label sheet of the print media is drawn between a platen and a thermal print head. The label sheet may be impregnated with a thermally active chemical, or alternatively, a thermally active ink ribbon may be drawn along with the label sheet between the platen and the thermal print head. The thermal print head has linearly disposed printing elements that extend across a width dimension of the label sheet. The printing elements are individually activated in accordance with instructions from a controller. As each printing element is activated, the thermally active chemical activates at the location of the particular printing element to produce the printed area. The label sheet is continuously drawn through the region between the platen and the thermal print head, and in so doing, the bar code is printed onto the label as it passes through the region. Other images, such as text characters, can be printed in the same manner.

The thermal transfer printer includes a mechanism for transporting the label sheet from a supply hub to the print region. It is desirable within the art to increase the rate at which the labels are printed. At the same time, it is also desirable to increase the overall width of the label (e.g., up to seven inches), which has driven a substantial increase in weight of the label roll (e.g., up to ten pounds). As a result, it is necessary to accelerate the heavy roll from a stationary state to an operational speed (e.g., greater than ten inches per second) as quickly as possible to prevent printing pitch errors. To overcome this problem, a low friction roller that permits a high acceleration rate is typically used to carry the label roll. A drawback of the conventional low friction rollers is that they make the rotating label roll difficult to decelerate and stop from the operational rate once the printing operation has completed. If the roll is permitted to decelerate on its own, a large quantity of the print media would spool off the roll, causing print registration errors, label jams, and consequent waste of the print media.

Accordingly, it would be desirable to provide a braking mechanism for a low friction print media supply hub for use in a thermal transfer printer. Such a braking mechanism should enable rapid acceleration at the commencement of printing operations and rapid deceleration once the printing operations have completed.

SUMMARY OF THE INVENTION

In accordance with the teachings of this invention, a brake apparatus for a printer is provided. The brake apparatus rapidly decelerates and stops a rotating roll of print media in between printing operations, and allows the roll to rotate freely during printing operations.

More particularly, the printer includes a print head mechanism that draws a print media to a print region from a roll of the print media. A roller supports the roll of print media and permits the roll to rotate freely upon application of a drawing force from the print head mechanism. A brake drum is axially coupled to the roller. A lever arm is affixed at a first end thereof to a support structure of the printer and is pivotal between a first position and a second position. A second end of the lever arm has a pedal that defines a portion of a path along which the print media follows toward the print region. The lever arm is pivoted to the first position by tightening of the print media upon application of the drawing force from the print head mechanism, and is pivoted to the second position upon slackening of the print media. A brake pad is coupled to an intermediate portion of the lever arm, and comes into contact with the brake drum only upon pivoting of the lever arm to the second position.

In an embodiment of the media roll braking system, the brake pad is disposed substantially level to the first end of the lever arm with the lever arm in the first position. The brake drum defines an arc that extends upwardly relative to a chord defined between the brake pad and the first end of the lever arm. The brake pad is disposed relative to the first end of the lever arm along a direction of rotation of the brake drum. This geometry ensures that the brake pad is forced into the brake drum upon pivoting of the lever arm to the second position.

A more complete understanding of the media roll braking system for a thermal label printer will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

This invention satisfies the need for a braking mechanism for a low friction print media supply hub for use in a thermal transfer printer. The braking mechanism enables rapid acceleration of the print media at the commencement of printing operations and rapid deceleration of the print media once the printing operations have completed. In the description that follows, like element numerals are used to describe like elements in one or more of the figures.

Figure 1:
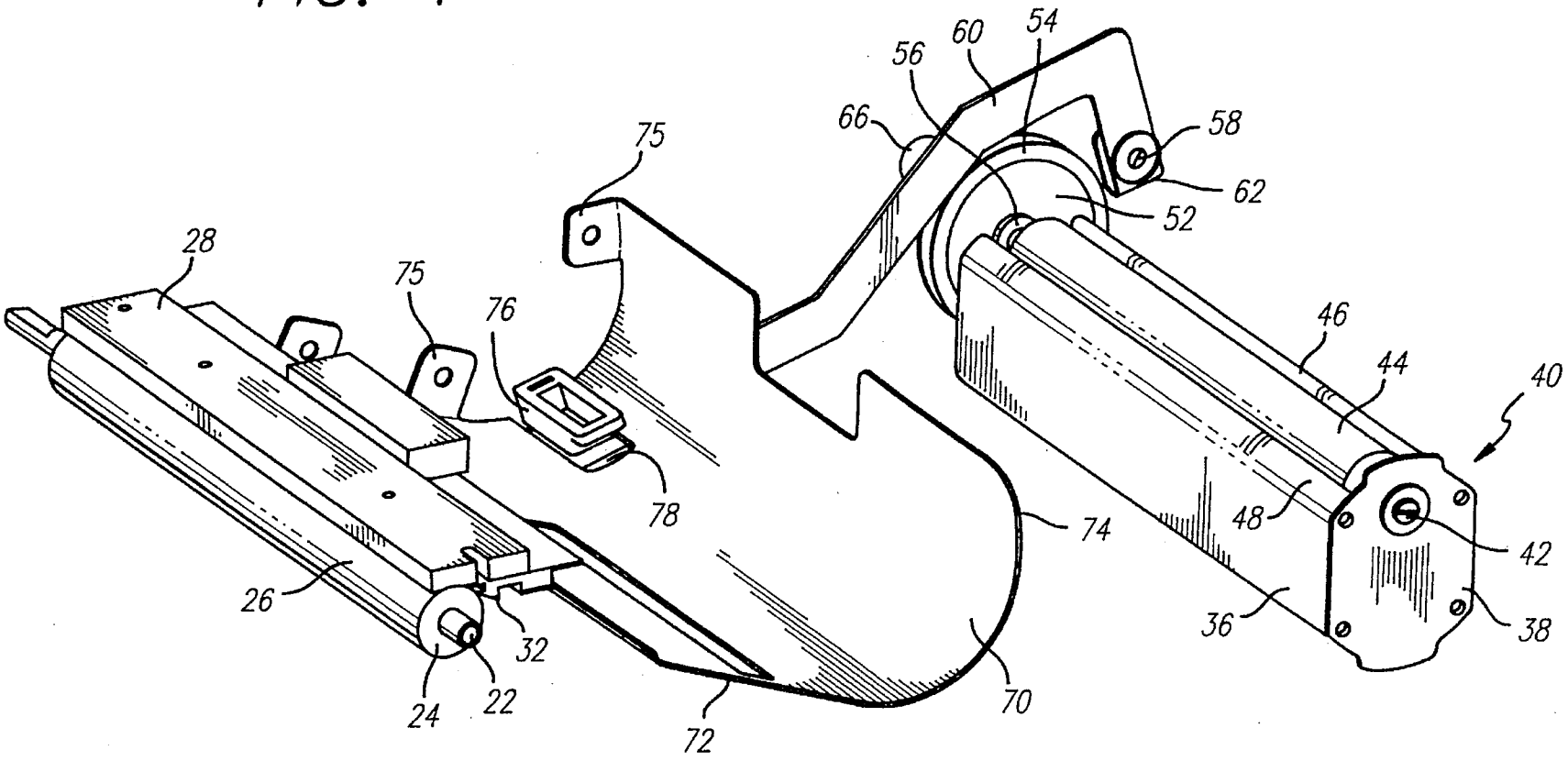
FIG. 1 is a perspective view of the media roll braking system of the present invention.
Figure 2:
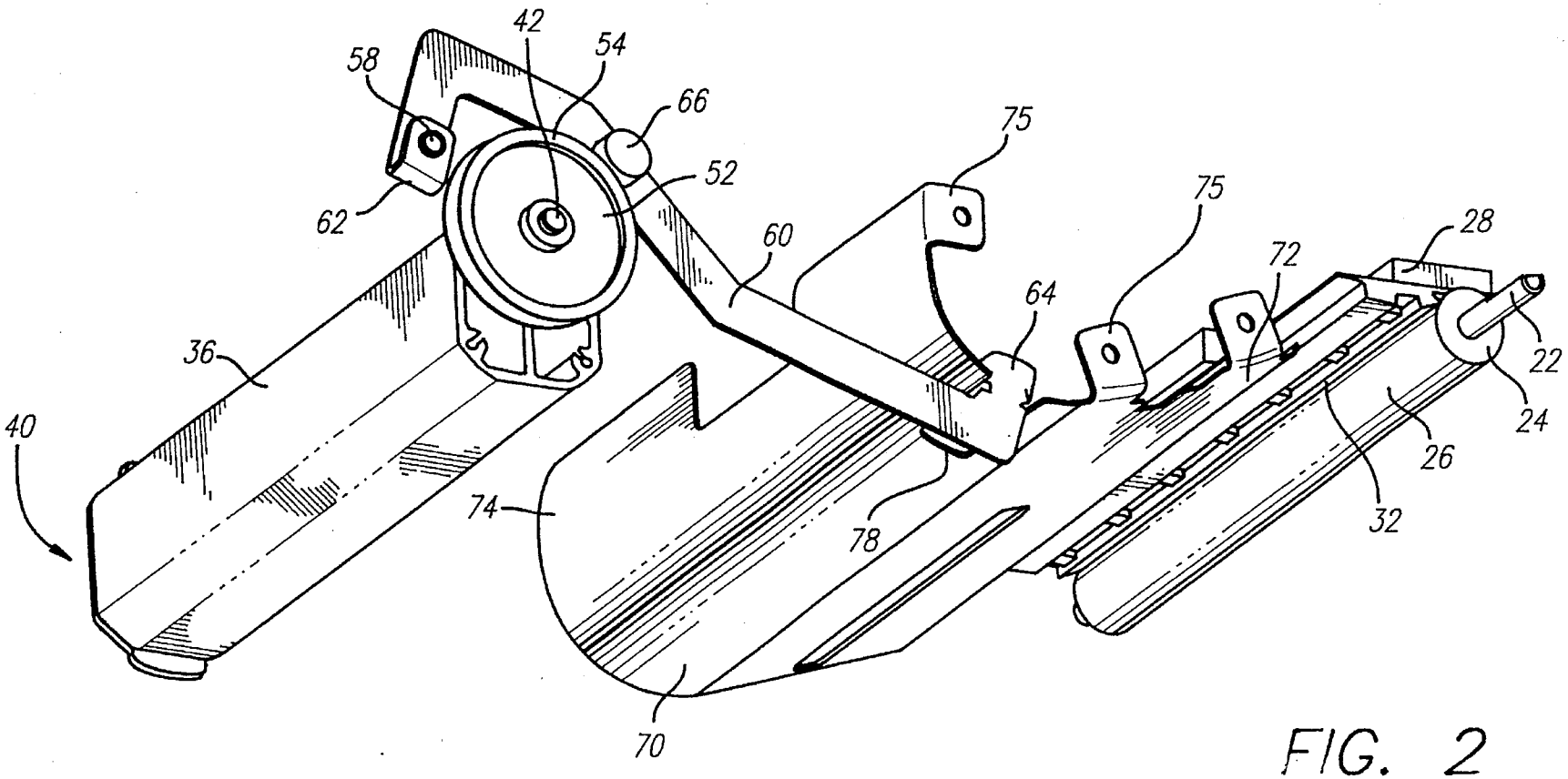
FIG. 2 is another perspective view of the media roll braking system.
Figure 3:
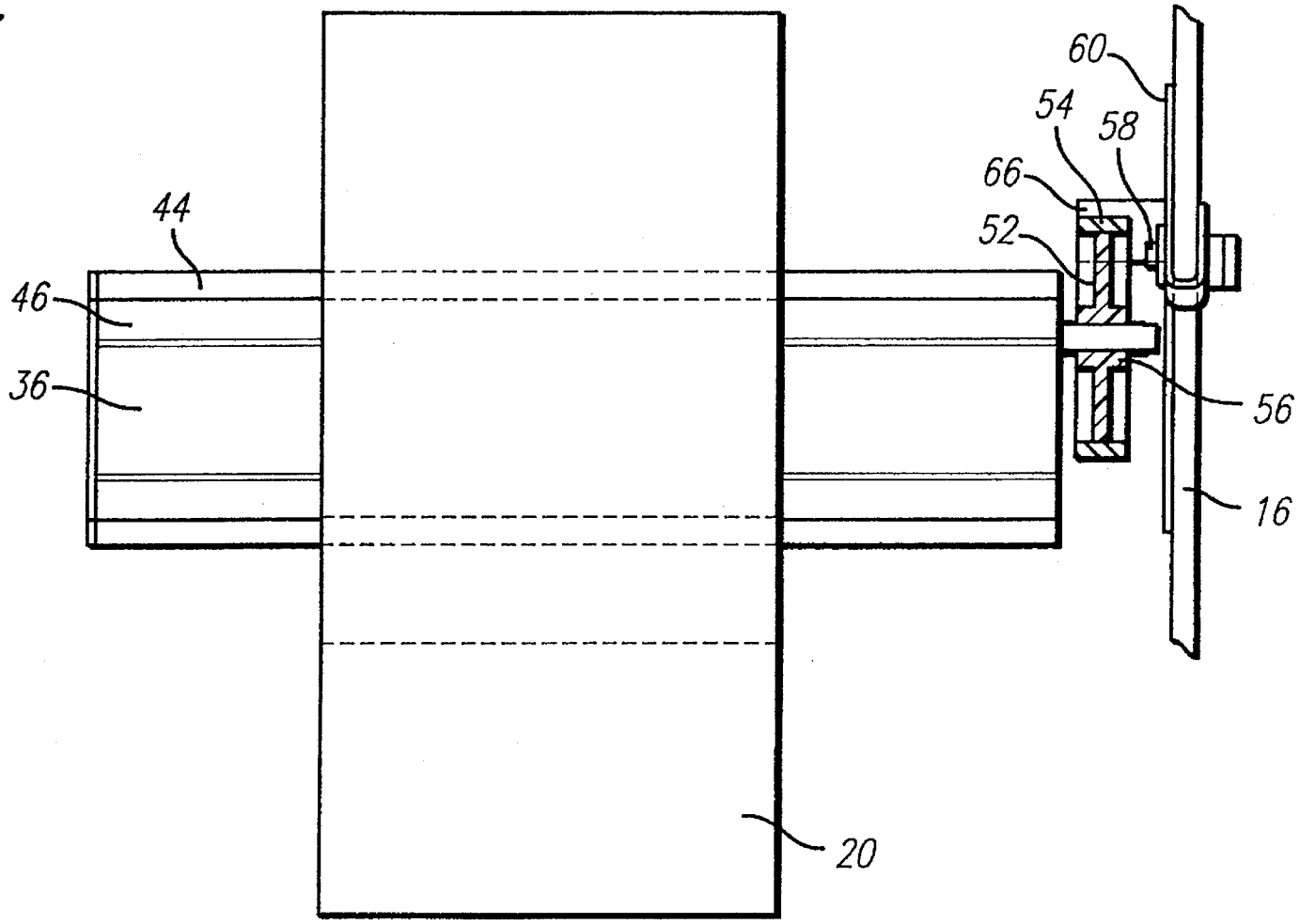
FIG. 3 is an end view of the media roll braking system.

Referring first to FIGS. 1–3, a braking mechanism for a thermal transfer printer is illustrated. The printer includes a platen 24 having a protruding end axle 22 and a roller surface 26. The axle 22 provides for support of the platen 24 at opposite ends thereof. The platen 24 is rotatable about the axle 22 by use of an external driving force, such as provided by a stepper motor driven gear and/or belt. A thermal print head 28 is disposed adjacent to the platen 24, and has linear print elements disposed along a surface 32 that faces the roller surface 26. A print region is defined between the surface 32 of the thermal head 28 and the roller surface 26 of the platen 24. As known in the art, the print head 28 receives electrical signals from a controller within the printer that control the sequence of activation of the individual print elements to effect the printing of desired information onto a print media. Rotation of the platen 24 under control of the external driving force will draw the print media through the print region. In view of these operational requirements, it is anticipated that the roller surface 26 be comprised of a material that is capable of withstanding high temperatures, while having sufficient surface roughness to maintain a friction coupling with the print media.

A supply hub 40 extends substantially parallel to the platen 24 and has a roller 44 with a central axle 42. The roller 44 is disposed within a housing 36 that is enclosed at a first end by an end plate 38. The housing 36 may be unitarily formed from plastic or metallic material, with a portion of the roller 44 extending outwardly though an elongated opening at an upper portion of the housing. The axle 42 extends outwardly through an aperture defined in the end plate 38, and is rotatably supported at that end by the aperture. A bearing may be disposed at the aperture to reduce the rotating friction of the roller 44. The housing 36 has a substantially rounded leading and trailing edge 48, 46 at upper surfaces thereof disposed on opposite sides of the roller 44.

Figure 4:
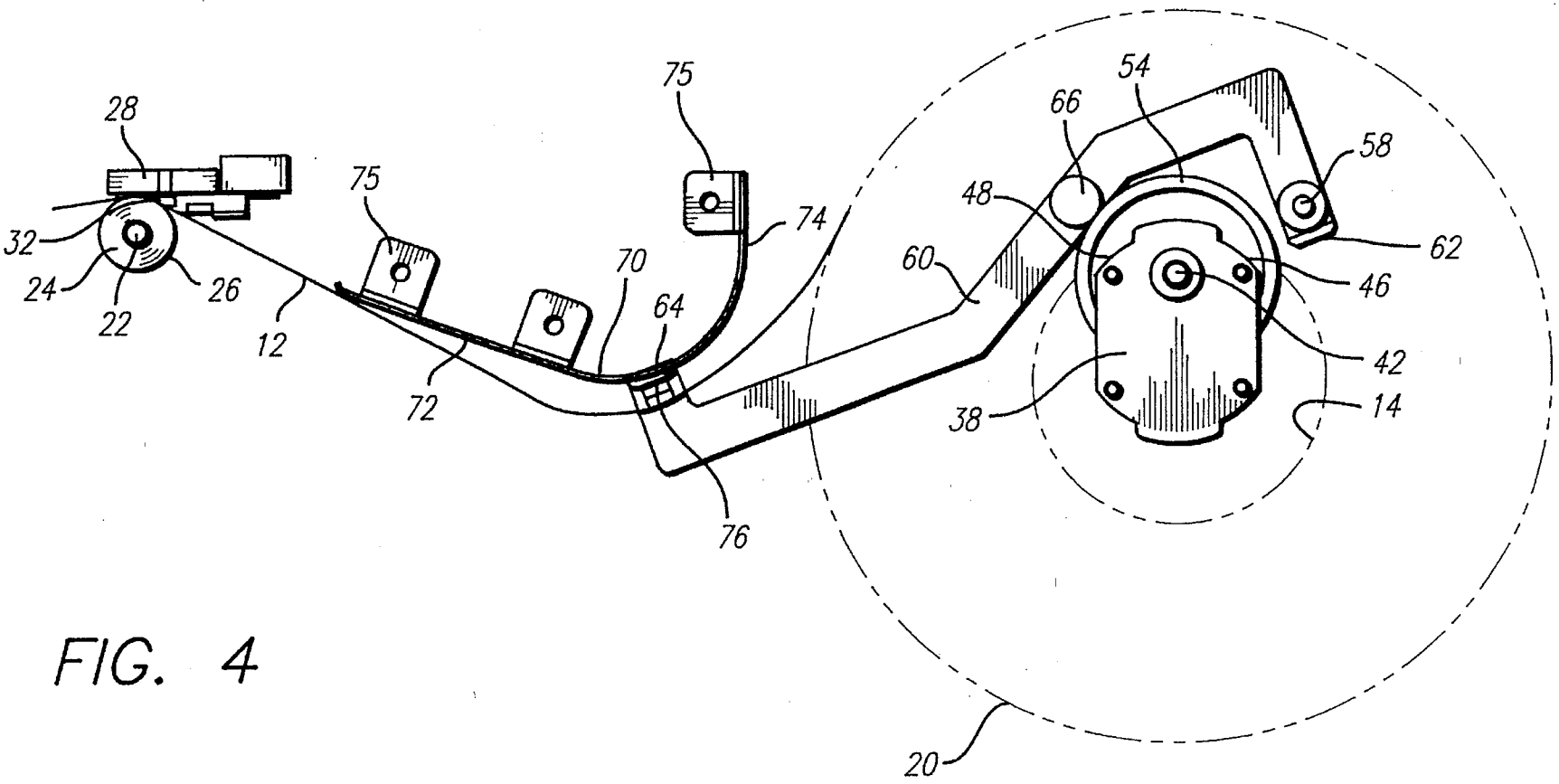
FIG. 4 is a side view of the media roll braking system with the lever arm pivoted to a first position in which rotation of the media roll is stopped.
Figure 5:
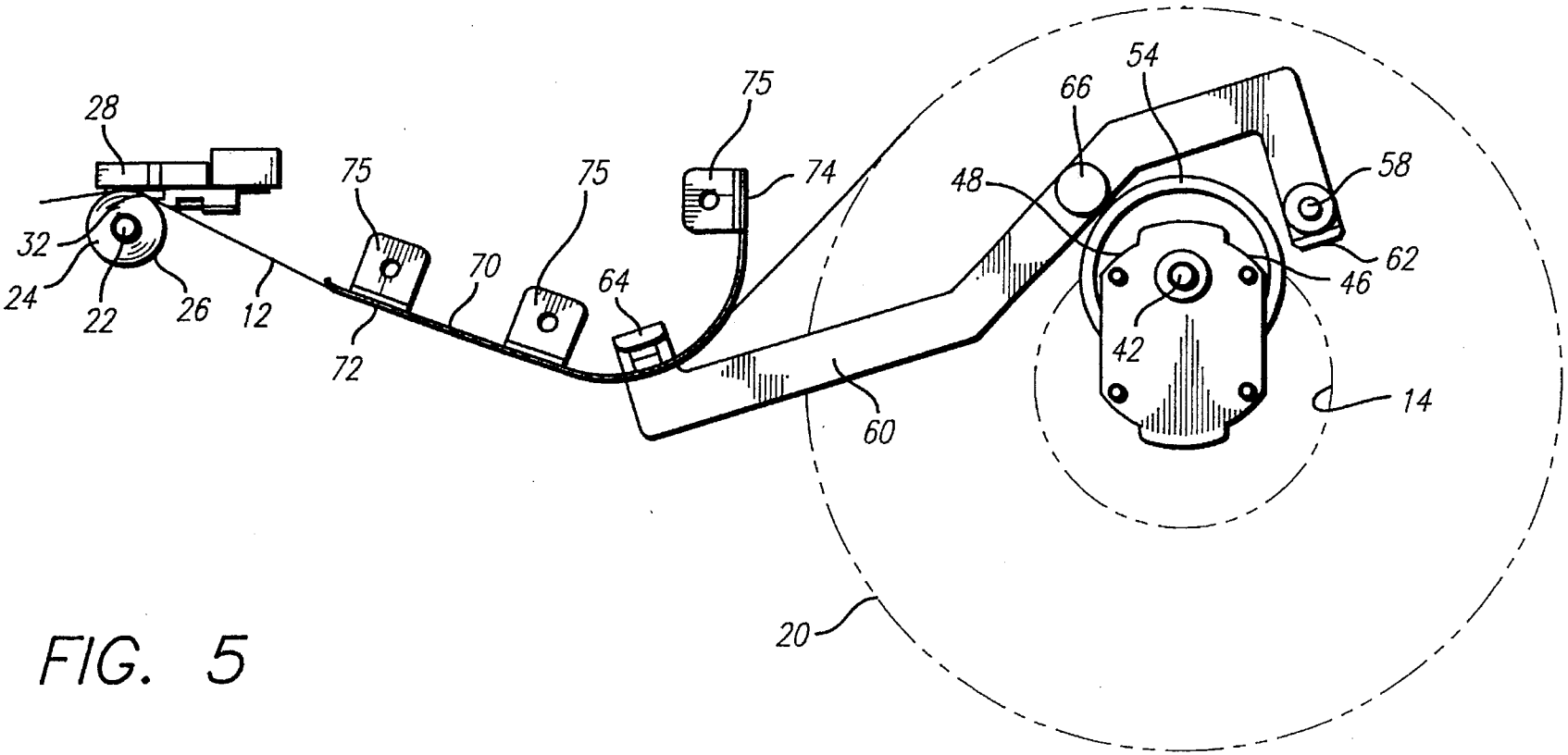
FIG. 5 is a side view as in FIG. 4 with the lever arm pivoted to a second position enabling free rotation of the media roll.

As illustrated in FIGS. 3 through 5, a print media roll 20 for use in the printer of the present invention comprises a paper substrate material wound onto a core 14. The paper substrate material may be impregnated with a thermally active chemical that reacts with heat provided by the thermal head to permit the printing of information thereon. As known in the art, the paper substrate may further contain perforations or other types of separation lines that permit the paper substrate material to be subdivided into individually removable labels. The paper substrate material may further have an adhesive layer disposed on a rear surface thereof, with a removable backing layer covering the adhesive layer.

The media roll 20 can be placed onto the roller 44 with the hub 40 disposed entirely within the core 14. The weight of the roll 20 rests substantially on the roller 44, with the leading and trailing edges 48, 46 of the housing 36 providing clearance so that the housing does not interfere with the rotational movement of the roll. By using a small diameter roller 44 having bearings that provide the roller with a very low rolling resistance, the print media roll 20 can be rapidly accelerated up to a relatively high rotational speed. Moreover, the hub 40 can accommodate varying sizes of print media rolls 20, as long as the core 14 has a diameter larger than the maximum width of the combined housing 36 and roller 44.

At the outside diameter of the roll 20, the print media 12 trails off the roll and is drawn toward the print region by operation of the platen 24. A guide 70 is disposed between the print region and the hub 40 and defines a path along which the print media 12 travels. The guide 70 has a width substantially equal to or greater than a maximum width of the print media 12, and has a curved portion 74 that transitions the direction of travel of the print media 12 as it passes from the roll 20 to the print region. The guide 70 further has an linear portion 72 that is oriented directly toward the print region. The guide 70 further includes a rectangular-shaped opening 78 that extends across the guide in a direction that is perpendicular to the print media path. The opening 78 provides a space for operation of the brake mechanism of the present invention, as will be further described below. A plurality of mounting flanges 75 extend from a side edge of the guide 70 that permit the guide to be rigidly secured to a mounting surface 16 of the printer.

In typical operation, the print media roll 20 is accelerated from a stationary position to full rotational speed by operation of the platen 24 in cooperation with the thermal head 28. Due to the low friction of the roller 44, it should be apparent that print media 12 will continue to spool off of the roll 20 well after the platen 24 has ceased drawing print media to the print region. Accordingly, the braking mechanism of the present invention is necessary to halt rotation of the media roll 20 in between printing operations.

The braking mechanism comprises a lever arm 60 that is pivotally coupled to the mounting surface 16 of the printer at a first end 62 of the lever arm. A pivot pin 58 secures the lever arm 60 to the mounting surface 16, and permits the lever arm to pivot about the pivot pin. A pedal 76 is coupled to an opposite end 64 of the lever arm 60. The pedal 76 extends through the opening 78 of the guide 70 and has a surface that contacts the print media 12. The pedal surface remains in contact with the print media as the print media tightens and slackens due to operation of the platen 25 and thermal head 28. Specifically, as the print media 12 tightens against the guide 70 during a printing operation, the pedal 76 floats upwardly until it is substantially flush with the surface of the guide (illustrated in FIG. 5). Once the printing operation has completed, the print media 12 slackens as the media spools off of the still rotating roll 20, and the pedal 76 sinks through the opening 78 (illustrated in FIG. 4).

A brake drum 52 is axially coupled to the axle 42 of the roller 44, such that the brake drum rotates in synchronism with the roller. The brake drum 52 comprises a disk having an outer rim 54 comprised of a pliable and abrasive material, such as rubber. The lever arm 60 has a brake pad 66 that extends perpendicularly from an intermediate portion of the lever arm in the proximity of the brake drum. The brake pad 66 may be cylindrical in shape, and may also be comprised of a pliable and abrasive material, such as rubber.

The brake pad 66 is disposed such that it comes into contact with the rim 54 of the brake drum 52 only after the pedal 76 has depressed a predetermined distance from the surface of the guide 70 (illustrated in FIG. 4), due to slackening of the print media 12. With the pedal 76 lifted to a position flush with the surface of the guide 70, the lever arm 60 pivots to withdraw the brake pad 66 from contact with the rim 54 (illustrated in FIG. 5). Accordingly, the print media 12 can be rapidly accelerated at the commencement of printing operations since the brake pad 66 will be pivoted away from the brake drum 52. Conversely, the print media 12 can be rapidly decelerated once the printing operations have completed since the brake pad 66 will be pivoted into the brake drum 52.

In an embodiment of the media roll braking system, the brake pad 66 is located at a point that is approximately level with the pivot point 58, with the rim 54 of the brake drum 52 defining an arc that extends upwardly relative to a chord line defined between the pivot point and the brake pad. The brake pad 66 is located at the end of the arc in the direction of rotation of the brake drum 52 so that the drum is essentially rotating into the pad as it brakes. This particular geometry ensures that the brake pad 66 is forced into the pliable rim 54 of the brake drum 52 due to the rotation of the drum (in the counterclockwise direction as illustrated in FIG. 4). As the torque of the rotating drum 52 increases, such as by use of higher print speeds or heavier media rolls, the amount of force exerted between the drum and the pad also increases. Thus, the appropriate amount of braking force is applied for varying sizes of media rolls and printing speeds.

Having thus described a preferred embodiment of media roll braking system for a thermal label printer, it should be apparent to those skilled in the art that certain advantages of the within system have been achieved. It should also be appreciated that various modifications, adaptations, and alternative embodiments thereof may be made within the scope and spirit of the present invention. For example, it should be apparent that the particular shape of the lever arm 60 is intended to fit within the dimensions of a conventional printer, and alternative shapes for the lever arm are possible as long as the brake pad 66 is properly oriented with respect to the brake drum 52. The invention is further defined by the following claims.

What is claimed is:

1. An apparatus including means for drawing a print media along a guide to a print region from a roll of said print media, comprising:

a rotatable roller supporting said roll of print media, said rotatable roller permitting said roll to rotate freely upon application of a drawing force from said drawing means;

a brake drum axially coupled to said rotatable roller;

a lever arm affixed at a first end thereof to a support structure of said apparatus and being pivotal between a first position and a second position, a second end of said lever arm having a pedal extending through a portion of said guide, said lever arm being pivoted to said first position by tightening of said print media upon application of said drawing force from said drawing means, said lever arm being pivoted to said second position upon slackening of said print media; and a brake pad coupled to said lever arm, said brake pad coming into contact with said brake drum only upon pivoting of said lever arm to said second position.

2. The apparatus of claim 1, wherein said brake pad is disposed relative to said first end of said lever arm along a direction of rotation of said brake drum, whereby further rotation of said brake drum draws said brake pad into said brake drum upon said lever arm being pivoted to said second position.

3. The apparatus of claim 2, wherein said brake pad is disposed substantially level to said first end of said lever arm with said lever arm in said first position.

4. The apparatus of claim 3, wherein said brake drum defines an arc that extends upwardly relative to a chord defined between said brake pad and said first end of said lever arm.

5. The apparatus of claim 1, wherein said brake drum comprises an abrasive outer surface.

6. The apparatus of claim 1, wherein said brake pad extends perpendicularly from an intermediate portion of said lever arm.

7. The apparatus of claim 1, wherein said print media comprises a thermal label.

8. The apparatus of claim 1, wherein said brake pad is coupled to an intermediate portion of said lever arm.

9. The apparatus of claim 1, wherein said brake drum and said first end of said lever arm are disposed such that a line passing through said brake drum and said first end of said lever arm form a chord of a circumference of said brake drum.

10. The apparatus of claim 9, wherein said brake pad is disposed relative to said first end of said lever arm along a direction of rotation of said brake drum, said direction of rotation being along an arc of said circumference of said brake drum defined by said chord, said arc having a length that is less than one-half said circumference of said brake drum.

11. The apparatus of claim 1, wherein said guide further comprises a curved portion for transitioning a direction of travel of said print media said drawing means draws said print media along said guide.

12. The apparatus of claim 11, wherein said guide further comprises a perpendicularly disposed opening in said curved portion, said pedal being disposed within said opening.

13. The apparatus of claim 1, wherein said rotatable roller further comprises a low friction roller.

14. An apparatus comprising:

means for drawing a print media to a print region from a roll of said print media;

a rotatable roller supporting said roll of print media, said rotatable roller permitting said roll to rotate freely in response to said drawing means;

a brake drum axially coupled to said rotatable roller;

an arm pivotally attached to a support structure of said apparatus, said arm having a pedal that contacts said print media as said print media travels toward said print region, said arm being pivoted to a first position by tightening of said print media by said drawing means, said arm being pivoted to a second position upon slackening of said print media; and a brake pad coupled to said arm, said brake pad coming into contact with said brake drum only upon pivoting of said arm to said second position.

15. The apparatus of claim 14, wherein said brake pad is disposed relative to a first end of said arm along a direction of rotation of said brake drum, whereby upon said arm being pivoted to said second position rotation of said brake drum draws said brake pad into said brake drum.

16. The apparatus of claim 15, wherein said brake pad is disposed substantially level to a pivot point of said lever arm with said lever arm in said first position.

17. The apparatus of claim 16, wherein said brake drum defines an arc that extends upwardly relative to a chord defined between said brake pad and said pivot point of said arm.

18. The apparatus of claim 14, wherein said brake pad is coupled to an intermediate portion of said arm.

19. The apparatus of claim 14, further comprising a guide having an opening therein and disposed between said drawing means and said rotatable roller, said pedal being disposed within said opening.

* * * * *